US009290249B2

(12) United States Patent
Masutani

(10) Patent No.: US 9,290,249 B2
(45) Date of Patent: Mar. 22, 2016

(54) BUOYANCY COMPENSATOR HAVING LOCKING SYSTEM

(71) Applicant: TABATA CO., LTD., Tokyo (JP)

(72) Inventor: Yutaka Masutani, Tokyo (JP)

(73) Assignee: TABATA CO., LTD., Tokyo (JP)

( * ) Notice: Subject to any disclaimer, the term of this patent is extended or adjusted under 35 U.S.C. 154(b) by 0 days.

(21) Appl. No.: 14/126,922

(22) PCT Filed: Oct. 22, 2013

(86) PCT No.: PCT/JP2013/006249

§ 371 (c)(1),
(2) Date: Dec. 17, 2013

(87) PCT Pub. No.: WO2014/064925

PCT Pub. Date: May 1, 2014

(65) Prior Publication Data

US 2015/0232159 A1 Aug. 20, 2015

(30) Foreign Application Priority Data

Oct. 22, 2012 (JP) ..... 2012-233269

(51) Int. Cl.
*B63C 11/30* (2006.01)

(52) U.S. Cl.
CPC ..... *B63C 11/30* (2013.01); *B63C 2011/303* (2013.01); *B63C 2011/306* (2013.01)

(58) Field of Classification Search
CPC ..... B63C 2011/306; B63C 2011/303; B63C 11/30
See application file for complete search history.

(56) References Cited

U.S. PATENT DOCUMENTS

| | | | | |
|---|---|---|---|---|
| 4,887,932 | A * | 12/1989 | Toth | 405/186 |
| 5,311,649 | A | 5/1994 | Suh | |
| 5,311,833 | A | 5/1994 | VanTassel et al. | |
| 6,154,936 | A | 12/2000 | Howell et al. | |
| 8,272,809 | B2 | 9/2012 | Carmichael | |
| 2002/0013107 | A1 | 1/2002 | Angelini et al. | |
| 2003/0150088 | A1 * | 8/2003 | Turpin | 24/579.09 |
| 2005/0074295 | A1 | 4/2005 | Kawashima | |
| 2013/0067691 | A1 * | 3/2013 | Godoy | 24/3.1 |
| 2013/0149038 | A1 * | 6/2013 | Toth | 405/186 |

FOREIGN PATENT DOCUMENTS

| | | |
|---|---|---|
| EP | 1520780 | 4/2005 |
| JP | 2005-112147 | 4/2005 |
| WO | 2012/075512 | 6/2012 |
| WO | WO 2012075512 A2 * | 6/2012 |

* cited by examiner

*Primary Examiner* — Frederick L Lagman
(74) *Attorney, Agent, or Firm* — Clark & Brody

(57) ABSTRACT

A buoyancy compensator having a locking system (27) that ensures the ballast (25) not to drop unexpectedly during diving and to removable by one hand of a scuba diver. The locking system (27) includes a releasing unit (30), a female locking unit (50) and a male locking unit (70). The releasing unit includes a turn leg (32) that is to be interposed between the female locking unit and the male locking unit. When the turn leg is forcedly turned at a certain angle clockwise or counterclockwise, an engagement of the male locking unit to the female locking unit is released.

9 Claims, 10 Drawing Sheets

BUOYANCY COMPENSATOR HAVING LOCKING SYSTEM

TECHNICAL FIELD

The present disclosure relates to a buoyancy compensator having a locking system for scuba divers.

BACKGROUND

Buoyancy compensators are known which include ballasts or cartridge weights for compensating buoyancy. For example, Patent Literature 1 discloses a buoyancy compensator that includes a vest configured to be worn by a scuba diver and pockets that are positioned on both front panels and into which ballasts are removably inserted. In this buoyancy compensator, the ballasts are linked to the pockets by means of buckles. Further, Patent Literature 2 discloses a buoyancy compensator in which ballasts are removably inserted pockets that are positioned on both front panels and enabled to be openably closed via zip fasteners.

CITATION LIST

Patent Literature

{PTL 1}
U.S. Pat. No. 8,272,809 B2
{PTL 2}
U.S. Pat. No. 5,311,833 B2

SUMMARY

Technical Problem

According to the buoyancy compensator disclosed in Patent Literature 1, release of the buckle enables the ballast to be readily removably out of the pockets. However, the buckles are exposed to the outside of the vest. Accordingly, while a scuba diver is diving, if an operation piece of the buckle collides with rock or the like, there is concern that the linking is released unexpectedly and the ballast drops out of the pocket. In such a case, the buoyancy becomes uncontrollable, and then, the diver is obliged to go up suddenly toward the water surface. As a result, there is a risk that a lung is damaged due to its expansion and the diver becomes unable to breath.

On the other hand, according to the buoyancy compensator disclosed in Patent Literature 2, a scuba diver can drop the weight by operating a support handle that links part of the pocket to the vest and orienting the opening of the pocket toward the lower side. Further, while the diver is diving, since the opening of the pocket is closed via the zip fastener, even if the support handle is actuated via collision with rock or the like and the opening of the pocket is oriented toward the lower side, there is no concern that the weight drops. However, usually, since the diver wears gloves in order to protect hands, it is difficult to grasp and operate an operation piece of the zip fastener in water. Accordingly, when the weight is needed to be removed quickly in an emergency, it is difficult to be removed out of the weight smoothly.

It should be noted here that there are also known Patent Literatures U.S. Pat. No. 5,944,450, U.S. Pat. No. 6,487,761 and U.S. Pat. No. 7,458,751 etc. These Patent Literatures have similar problems to Patent Literature 1.

An object of the present invention is to improve conventional buoyancy compensators, and in particular, to provide buoyancy compensators having a locking system that ensures a ballast not to drop unexpectedly during diving and to be readily removed out of a pocket by a scuba diver's one hand.

Solution to Problem

In order to solve the above-mentioned problems, there is provided a buoyancy compensator having a locking system including the following features.

A buoyancy compensator having a locking system having a forward direction and a backward direction, includes:

a vest having a pocket in which a ballast is removably inserted;

a cover flap configured to openably close an opening of the pocket;

a locking system configured to openably close the cover flap;

the locking system includes a releasing unit attached to the ballast;

a female locking unit attached to the pocket; and a male locking unit attached to the cover flap and configured to be engageable with the female locking unit;

wherein:

the releasing unit includes a turn leg and an operation knob on the turn leg;

the female locking unit includes a frame including both side portions, a front end portion, an arrangement space defined by the both side portions and the front end portion, and a pair of first claws in the guide grooves;

the male locking unit includes a stationary potion, a movable member slidably inserted in the stationary member by a certain movement range in the forward and backward directions with being urged in the forward direction by a spring interposed between the stationary member and the movable member of the male locking unit;

in an engagement of the male locking unit to the female locking unit, the turn leg is arranged between the front end portion of the female locking unit and the movable member of the male locking unit, with the turn leg brought in contact with the front end portion and the movable member, the first claws of the female locking unit and the second claws of the hook arms of the male locking unit are releasably hooked to each other, when the turn leg is forcedly turned at a certain angle in a turn direction thereof by turn operation of the operation knob, the movable member of the male locking unit is pressurized by the turn leg of the releasing unit so as to slide in the backward direction against urge of the movable member by the spring in the forward direction, whereby the first claws of the hook arms of the stationary member that are hooked to the second claws of the female locking unit, is shifted to sides that hooking of the second claws to the first claws are released, as a result, the engagement of the male locking unit to the female locking unit is released.

Advantageous Effects of Invention

The buoyancy compensator having the locking system according to one or more embodiments of the present invention, in order to release the locking system, when the cover flap of the pocket configured to openably close the opening of the pocket in which the ballast is inserted, the operation knob is forcedly needed turned on the turn leg at a certain angle in the turn direction. Therefore, even if part of the locking system collides with rock or the like, there is no concern that the locking is released carelessly.

BRIEF DESCRIPTION OF DRAWINGS

The drawings illustrate specific embodiments of the present invention including optional and preferred embodiments as well as essential features of the invention.

DESCRIPTION OF EMBODIMENTS

Figure 1:
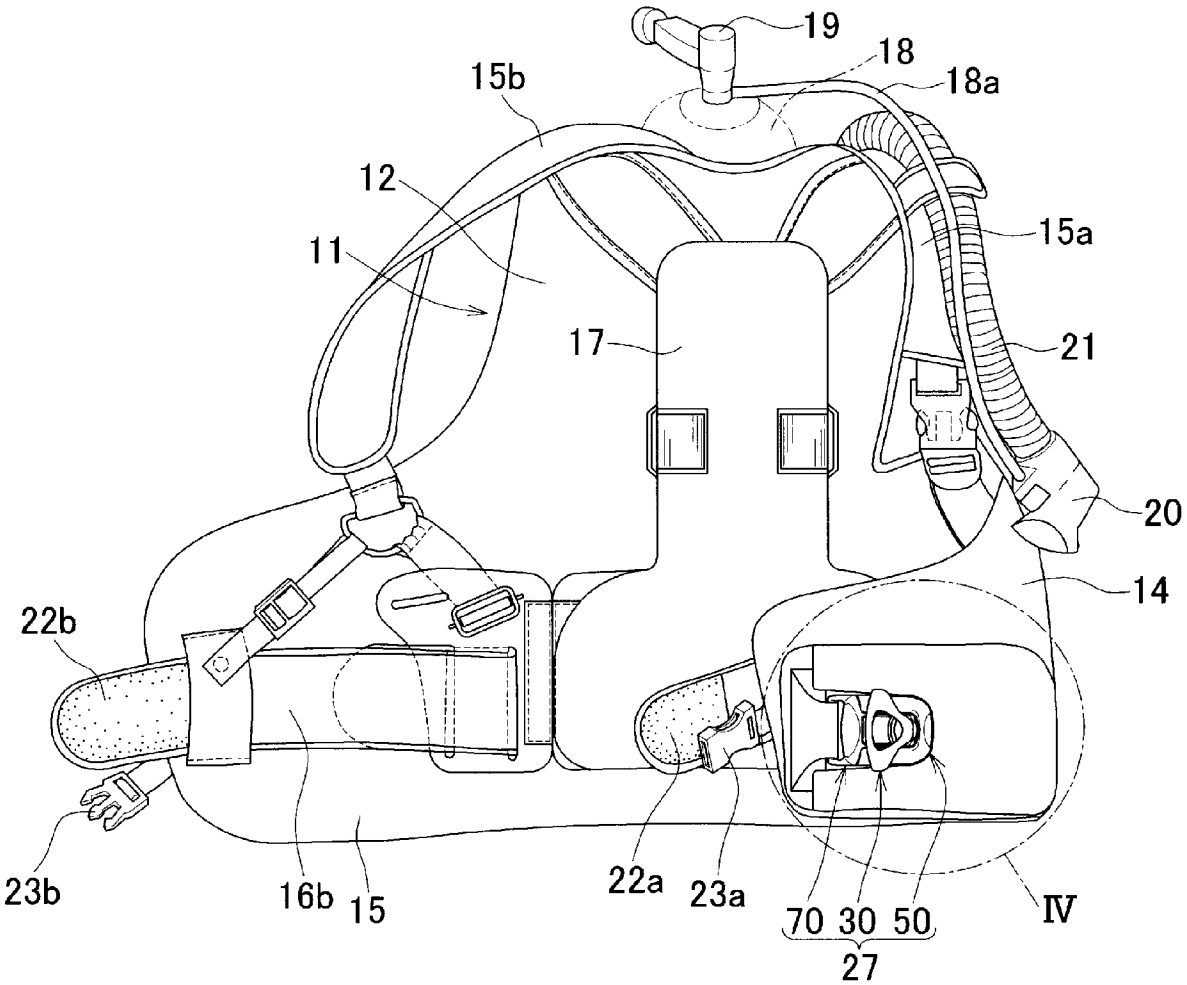
FIG. 1 is a front view of a buoyancy compensator having a locking system.

The embodiments described below relate to a buoyancy compensator having a locking system illustrating FIGS. 1 through 10 including both optional and preferred features of the invention.

Referring to FIGS. 1 through 6, a buoyancy compensator having a locking system 27 according to some embodiments of the present invention includes a vest or jacket 11 (hereinafter referred to as "vest") including a back panel 12, a pair of left and right front panes 14, 15, a pair of shoulder straps 15*a*,15*b*, and a pair of waist straps 16*a*,16*b*, a harness 17 attached to the back panel 12, an air tank 18 secured to the harness 17, a high pressure hose 18*a* coupled to a pressure reducing valve 19 of the air tank 18, a power inflator 20 coupled to the high pressure hose 18*a*, and an inflator hose 21 coupled to a breather portion (not shown) that is extended from the power inflator 20.

Figure 4:
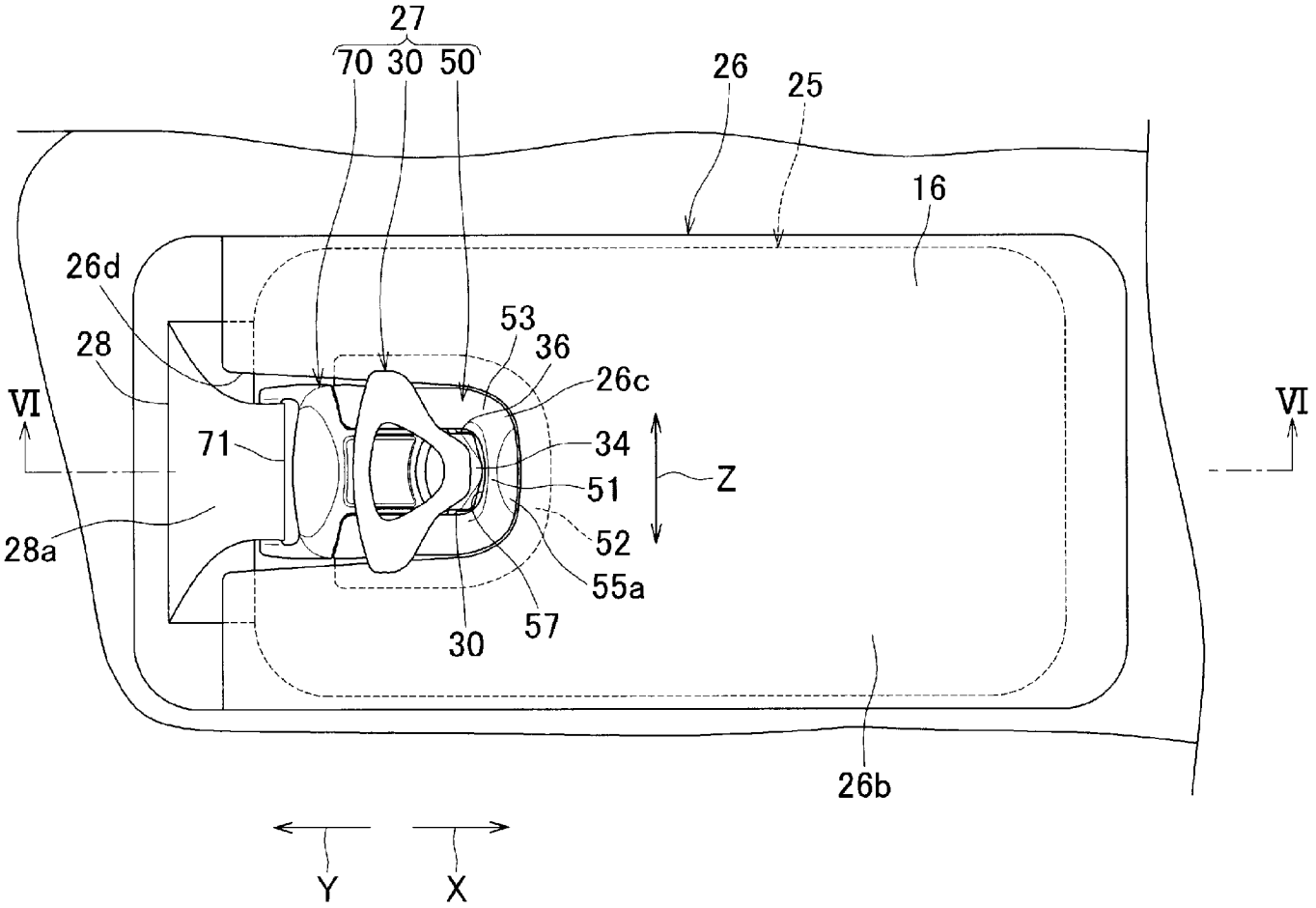
FIG. 4 is an enlarged view of a portion surrounded by a circular line IV in FIG. 1.
Figure 5:
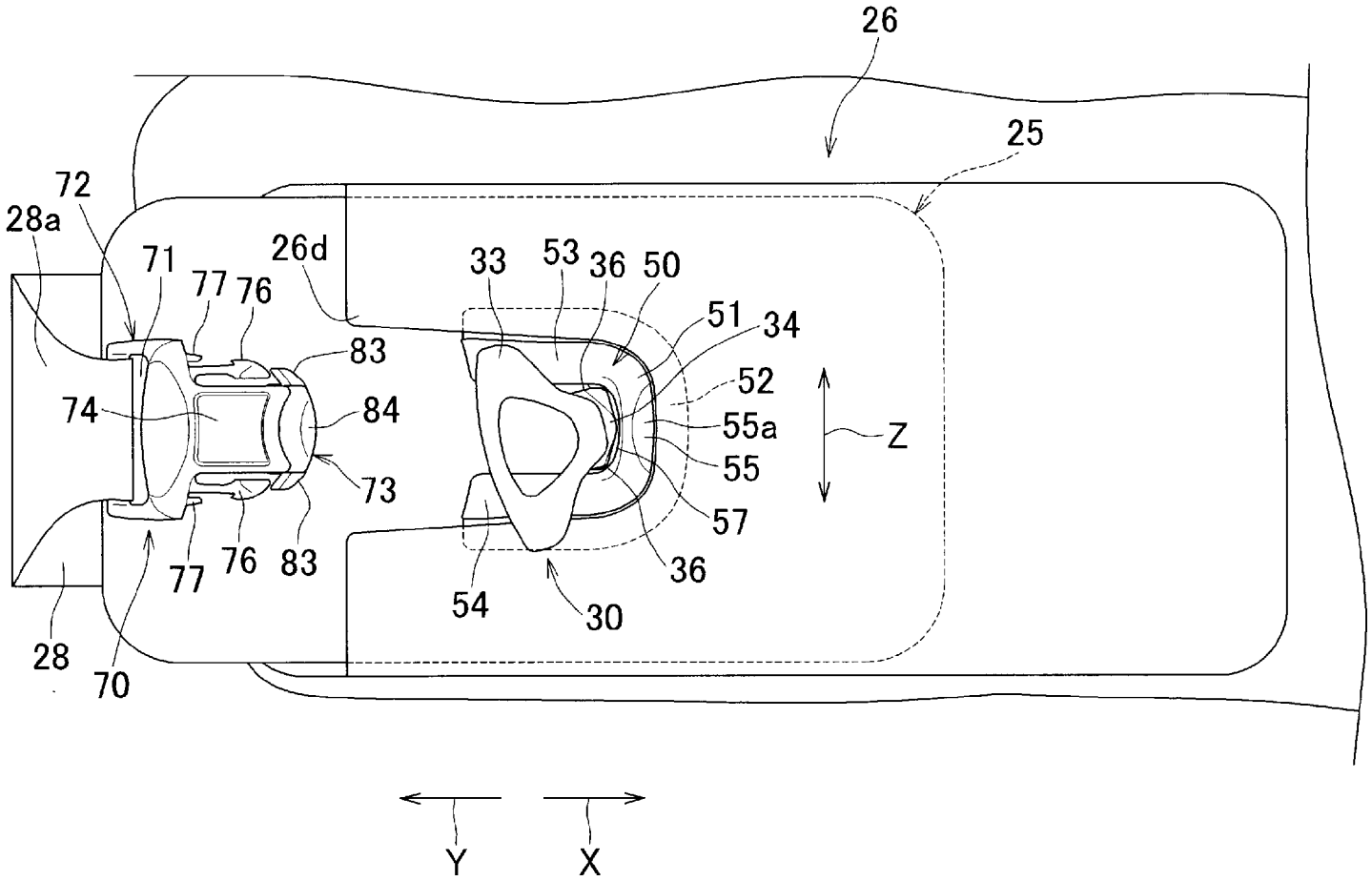
FIG. 5 is a front view of the locking system similar to FIG. 4 at the time of release of the locking of the locking system.
Figure 6:
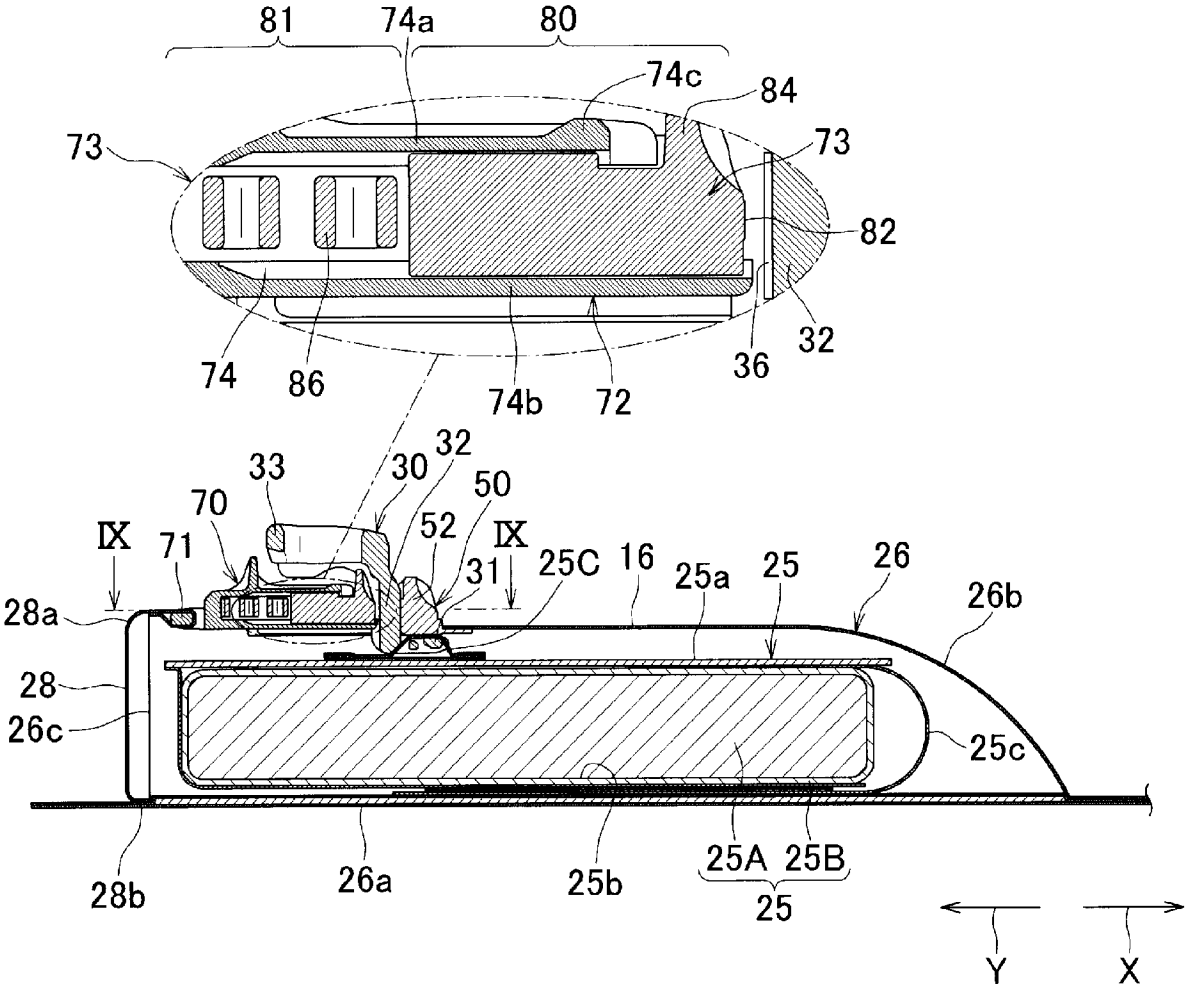
FIG. 6 is a cross-section view taken along line VI-VI in FIG. 4.

On the outer surface of the waist strap 16*a* attached to the left front panel 14 and on the inner surface of the waist strap 16*b* attached to the right front panel 15, a pair of fasteners 22*a* and 22*b* engageable with each other are respectively disposed. Also, to the left and right front panels 14, 15, female and male buckles 23*a*, 23*b* to be releasably engaged with each other are respectively disposed. Each of the left and right front panels 14, 15 includes a pocket 26 for insertion of a ballast or cartridge weight 25 (hereinafter referred to as "ballast"). As shown in FIGS. 4 to 6, the pocket 26 includes a relative stiff base panel 26*a* made of material such as plastics integrally covered with fabric, a flexible cover 26*b* made of material such as fabric, a cover flap 28 and an opening 26*d* to be openably closed with the cover flap 28 by means of a locking system 27. The cover flap 28 includes a distal end portion 28*a*, a proximal end portion 28*b* secured adjacently to the opening 26*d* of the pocket 26 (see FIG. 6). Although not shown, the pocket 26 may be formed separately from the vest 11 so that the pocket 26 may be releasably attached to the vest 11, for example, by means of mechanical fasteners (Velcro).

Figure 2:
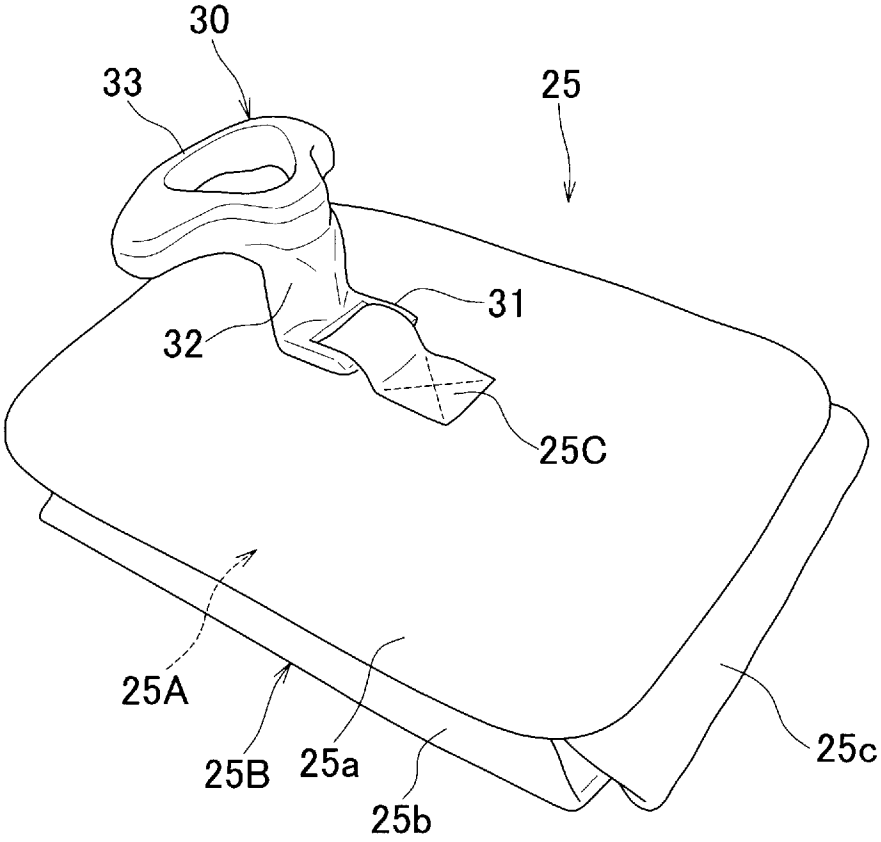
FIG. 2 is a perspective view of a ballast.
Figure 3:
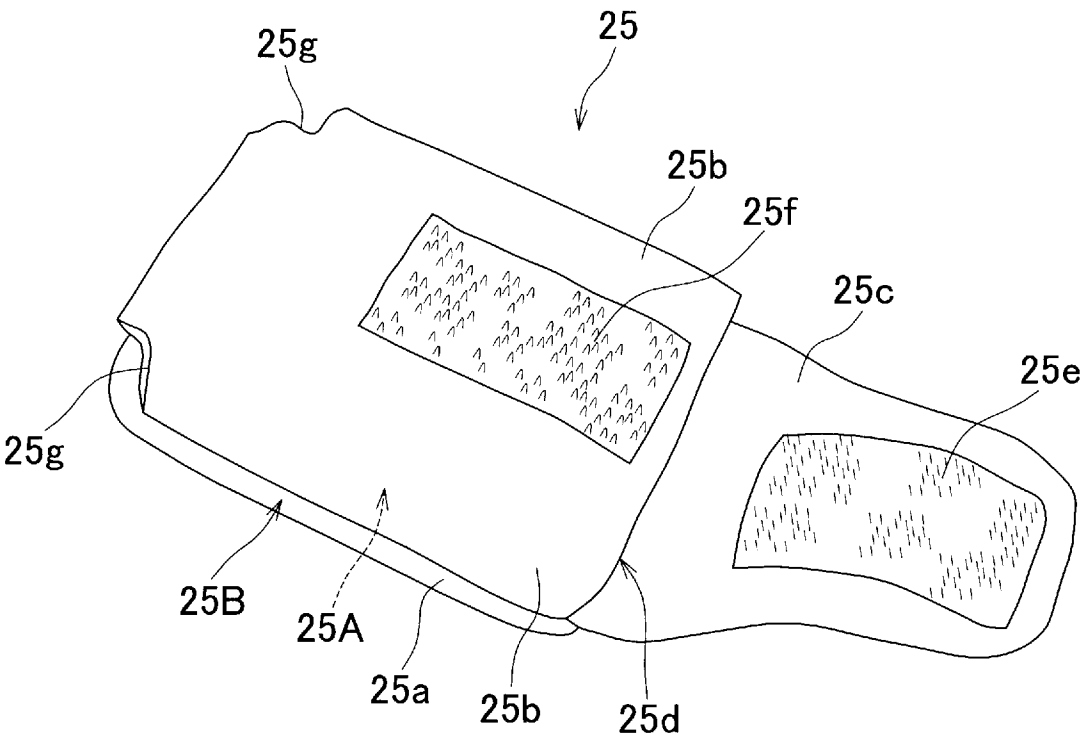
FIG. 3 is a perspective view of the ballast with a cover flap thereof opened.

As shown in FIGS. 2, 3, the ballast 25 generally includes a weight 25A of the required amount made of metal such as leads or iron and a cartridge 25B made of fabric or plastic material. The cartridge 25B includes a stiff base panel 25*a* made of material such as plastic integrally covered with fabric, a flexible cover 25*b*, a cover flap 25*c* to openably close an opening 25*d* by means of mechanical fasteners 25*e*, 25*f* and draining openings 25*g*.

As shown FIGS. 1, 4 to 6, the locking system 27 has a forward direction X, a backward direction Y and a width direction Z orthogonal to the forward and backward directions X, Y, and includes a releasing unit 30, a female locking unit 50, a male locking unit 70 to be releasably engageable with the female locking unit 50 wherein the releasing unit 30 is held between the female and male locking units 50, 70, as will be described later. The locking system 27 may be disposed on the left and right front panels 14, 15, respectively, however, in the drawings, the locking system 27 is shown only on the left front panel 14. It is preferable that the releasing unit 30, the female locking unit 50, and the male locking unit 70 be formed of relatively hard material that are capable of producing elastic defomablity, elastic restoration or spring properties, for example, such as plastics, rubber and metal.

As shown in FIGS. 2, 4 the releasing unit 30 is linked to the ballast 25. More specifically, the releasing unit 30 is linked onto the base panel 25*a* of the cartridge 25B constituting the ballast 25 such that a foot 31 of the releasing unit 30 is turnably linked onto the base panel 25*a* of the cartridge 25B by means of a strap piece 25C secured to the base panel 25*a*. The female locking unit 50 is attached along the inner peripheral edge of an approximately U-shaped notch 26*c* defined adjacently to the opening 26*d* of the pocket 26. The male locking unit 70 is attached to the distal end portion 28*a* of the cover flap 28 of the pocket 26 by means of a linkage portion 71 of the back end of the male locking unit 70.

Figure 7:
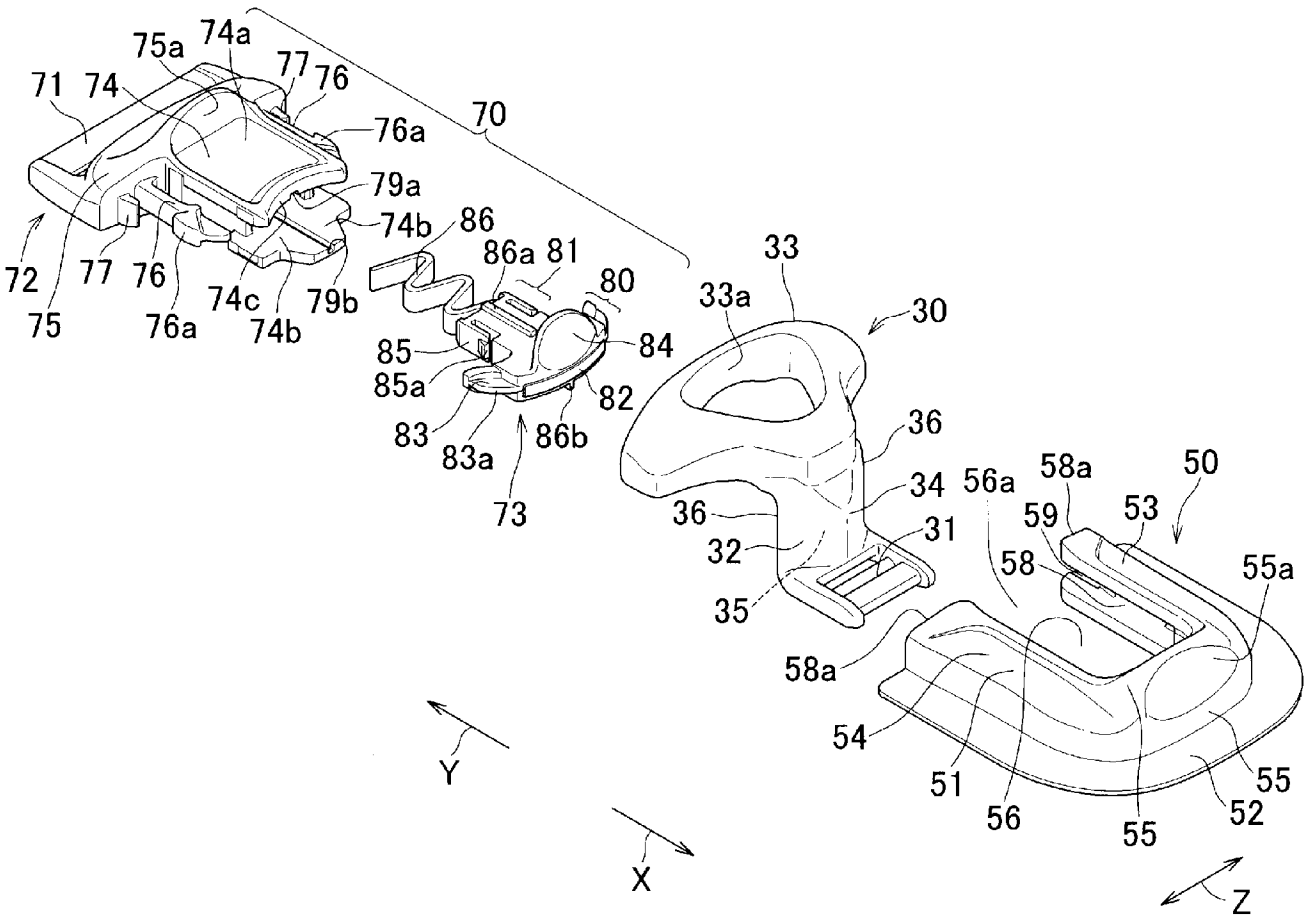
FIG. 7 is an exploded perspective view of the locking system.
Figure 8:
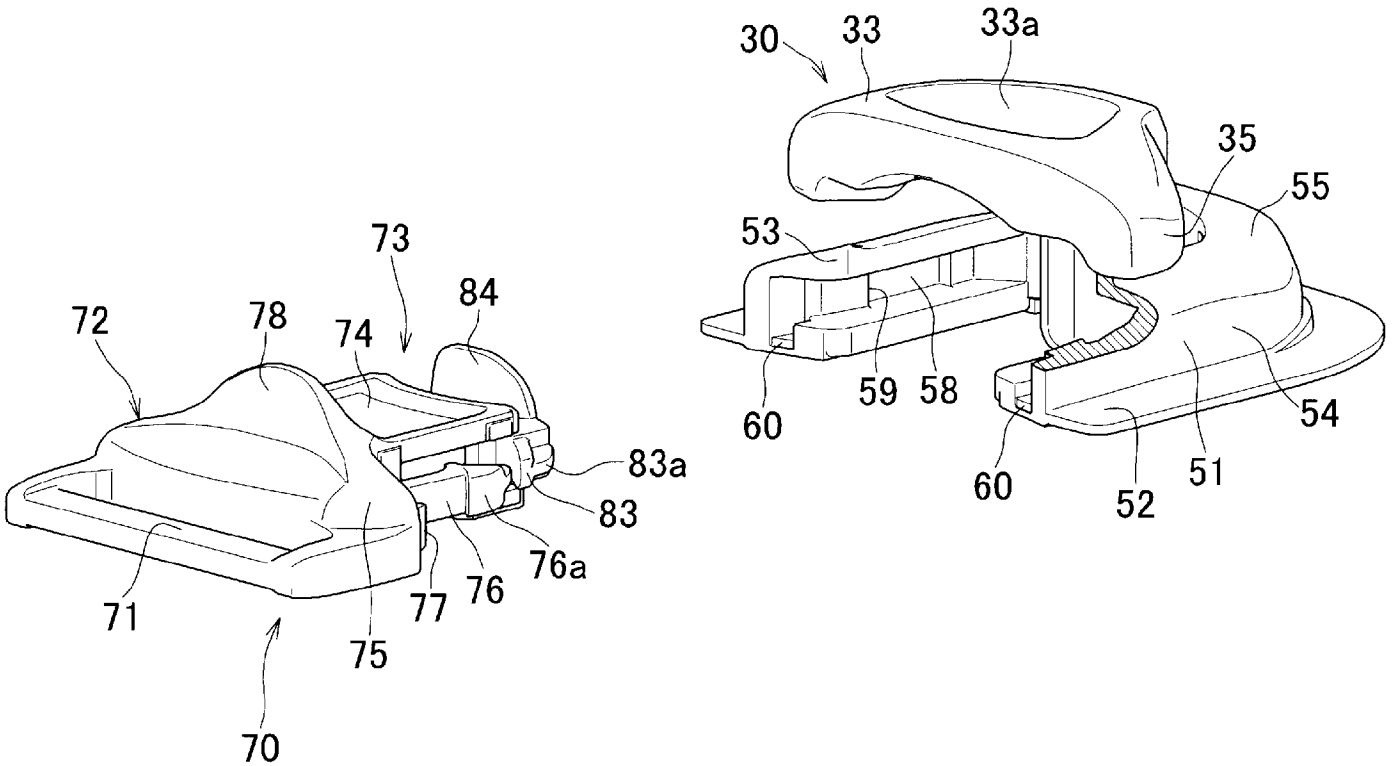
FIG. 8 is an exploded perspective view of a female locking unit in which a releasing unit is located and a male locking unit.

Referring to FIGS. 6 through 8, the releasing unit 30 includes, in addition to the foot 31, a turn leg 32 on the foot 31 and an approximately triangular-shaped operation knob 33 having an opening 33*a* for passing through a diver's finger. The foot 31 is configured to turnably and stably support the turn leg 32 on the ballast 25 by means of the strap piece 25C (see FIG. 2) with standing up. The turn leg 32, which serves as a shaft and is forcedly turned by the operation knob 33, as will be described later, is formed in an appropriately triangularly convex shape in a cross-section such that the turn leg 32 is formed with a convex front surface 34, a concave back surface 35 and a pair of both side edges 36 curved toward the backward direction Y.

The female locking unit 50 includes an approximately U-shaped frame 51 formed along the inner peripheral edge of an approximately U-shaped flange 52 that is secured along the inner peripheral edge of the approximately U-shaped notch 26*c* (see FIGS. 4, 5) of the pocket 26. The frame 51 includes both side portions 53, 54 and a front end portion 55 by which an approximately U-shaped arrangement space 56 is defined. The arrangement space 56 is opened on the open side 56*a* opposed to the front end portion 55. The front end portion 55 is provided on its inner surface with a concave surface 57 defined in a widely opened V-shape (see FIG. 9), which may serve as a part of a bearing and with which a middle portion of the convex surface 34 of the turn leg 32 is slidably brought in contact in a locking state of the locking system 27. The front end portion 55 is also provided on its outer surface with a diver's hold portion 55*a*. The both side portions 53, 54 are provided along their insides with a pair of guide grooves 58 that are opened toward the arrangement space 56 as well as toward the backward Y. The guide grooves 58 are provided in vicinities of opening ends 58*a* of the guide grooves 58 with a pair of claws 59 with a pair of receiving grooves 60.

The male locking unit 70 includes a stationary member 72 and a movable member 73 slidably inserted into the stationary member 72. The stationary member 72 includes a hollow middle portion 74 having a hollow 74*a* therein and extending from a proximal portion 75 in the forward direction X and composed of both upper and lower portions 74*a*, 74*b*, and both side walls (not shown), a pair of elastically deformable hook arms 76 each having a claw 76*a* that extends on the both sides of the hollow middle portion from the proximal portion 75 toward the forward direction X wherein the claw 76*a* are releasably hookable to each of the claws 59 of the female locking unit 50, a pair of stabilizing protrusions 77, which are releasably fit into the guide grooves 60 of the female locking unit 50, protruding on the outsides of the elastic hook arms from the proximal portions 75 toward the forward direction X, a diver's concave hold portion 75*a* protruding upwardly from the proximal portion 75, a pair of hook arms 78 each having a claw 78*a*, extending from the opening end of the hollow 74*a* toward the forward direction X within the stationary member 72, and a pair of line-shaped guide grooves 79*a*, 79*b* in the forward and backward directions X, Y. It should be noted here that the stabilizing protrusions 77 is difficult to be elastically deformable even if being applied with a certain force, because they are rather shorter than the elastic hook arms 76.

The movable member 73 includes a forward portion 80 protruding from the front end 74*a* of the upper portion 74*a* in the forward direction X and a backward portion 81. The forward portion 80 includes a convex head edge 82, a pair of shoulder portions 83 having ribs 83*a* and being curved in the backward direction Y wherein the outer edge surfaces of the convex head edges 82 and the shoulder portions 83 are convexly continuous to each other, and a diver's push portion 84 that protrudes slightly inclining in the backward direction Y on the convex head edge 82. The backward portion 81 includes a pair of hook arms 85 each having a claw 85*a* extending on the both sides from the back end of the movable member toward the forward direction X, a pair of line-shaped guide protrusions 86*a*, 86*b* extending in the forward and backward directions X, Y on the upper and lower surface of the movable member 73 wherein the guide protrusion 86*a*, 86*b* are slidably fit into the guide grooves 79*a*, 79*b* of the stationary member 72, and a zigzagging spring 86 extending from the end of the backward portion 81 in the backward direction Y. The spring 86 may be formed separately from the back portion 81 as long as the spring 86 exerts the required spring force.

The spring 86 is located within the follow 74*a* in a state of being elastically compressed in the forward and backward directions X, Y, and consequently, the movable member 73 is urged in the forward direction X. The movement range of the movable member 73 in the forward and backward directions X, Y is restricted by at least one of the respective lengths of the guide grooves 79*a*, 79*b* and the guide protrusions 86*a*, 86*b* in the forward and backward X, Y and the respective lengths of hook arms 78, 85 except their claws 78*a*, 85*a*. The detachment of the movable member 73 out of the stationary member 72 is prevented by one of the fitting of the guide grooves 79*a*, 79*a* and the guide protrusions 86*a*, 86*b* and the hooking of the claws 78*a* of the hook arms 78 and the claws 85*a* of the hook arms 85. As will be appreciated by a later description, it is preferable that the expanding (bound back) force of the spring 86 is as great as possible so that the urge of the movable member 73 may be exerted greatly as possible. This is because, the turn leg 32 of the releasing unit 30 brought in contact with the convex head edge 82 of the movable member 73 cannot be easily turned, whereby the movable member 73 is easily not slidable in the backward direction Y, as long as the turn leg 32 is forcedly not turned by means of the operation knob 33 clockwise or counterclockwise so that the engagement of the female and male locking units 50, 70 may be released.

Figure 9:
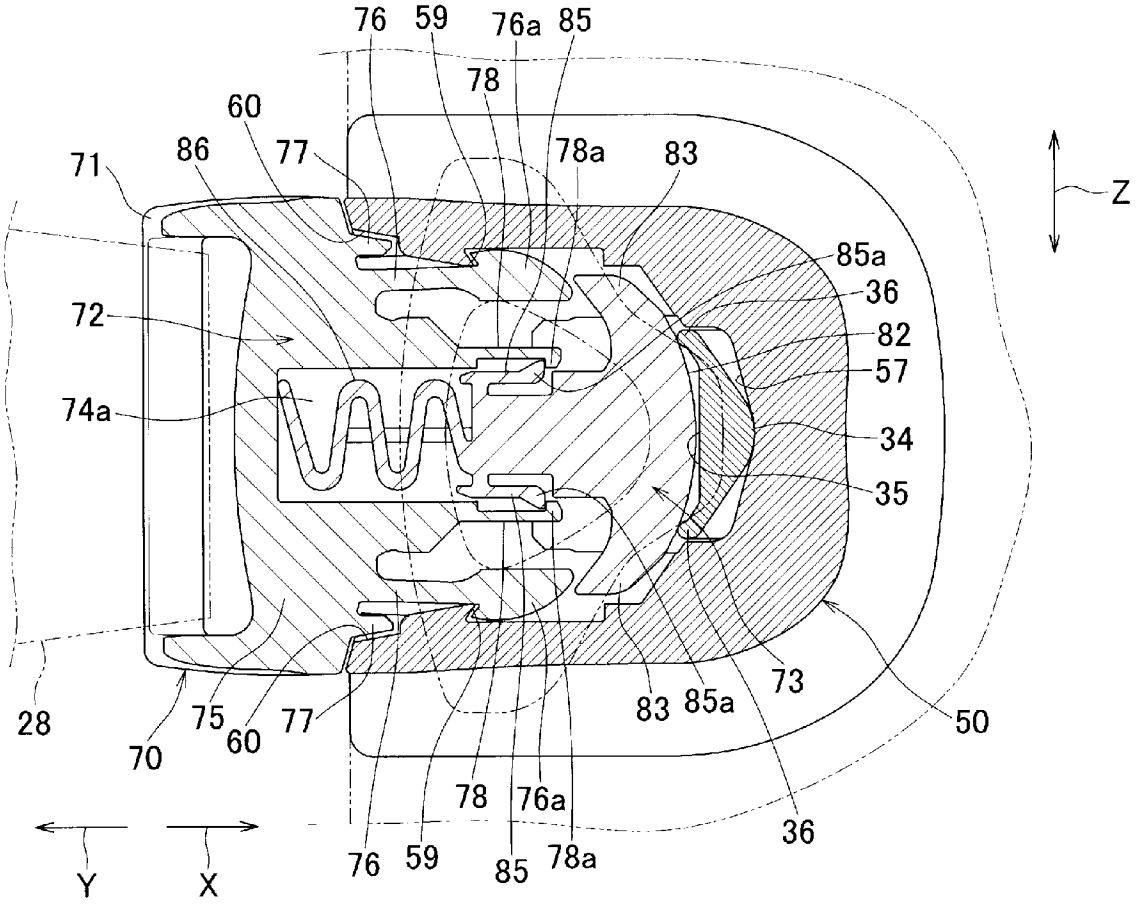
FIG. 9 is a cross-section view taken along line IX-IX in FIG. 6.
Figure 10:
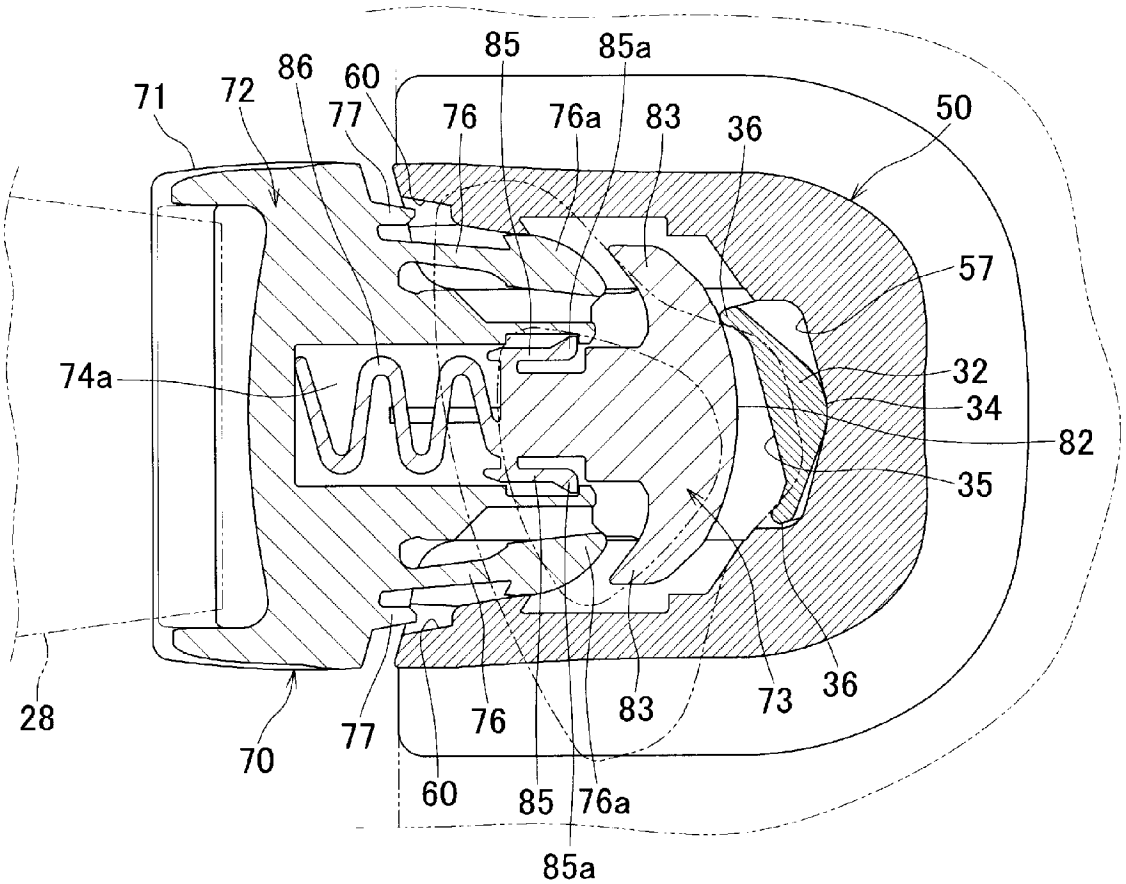
FIG. 10 is a cross-section view similar to FIG. 9 in a state in which the locking of the locking system has been released.

As shown in FIGS. 1,9,10, in a locking state of the locking system 27, the ballast 25 is inserted into the pocket 26 together with the releasing unit 30 such that the turn leg 32 of the releasing unit 30 is located in the arrangement space 56 of the female locking unit 50 and the foot 31 of the turn leg 32 is inserted between the ballast 23 and the flange 52 of the front end portion 55 of the female locking unit 50. The male locking unit 70 is inserted from the opening side 56*a* (see FIG. 7) of the arrangement space 56 into the arrangement space 56 so that the movable member 73 may be brought in contact with the turn leg 32 of the releasing unit 30 while the turn leg 32 is brought in contact with the concave surface 57 of the female unit 50, in a state that the hollow middle portion 74 is located in the arrangement space 56, the shoulder portions 83 are inserted into the guide grooves 58 of the female locking unit 50, and the claws 59 of the female locking unit 50 and claws 76*a* of the hook arms 76 of the male locking unit 70 are hooked to each other, and the stabilizing protrusions 77 of the male locking unit 70 are fit into the receiving grooves 60 of the female locking unit 50. In such state, the turn leg 32 is securely held between the concave surface 57 of the female locking unit 50 and the convex head edge 82 of the movable member 73 of the male locking unit 70 under expansion of the spring 86, and the movable member 73 is urged by the expansion of the spring 86, i.e., the spring force of the spring 86 in the forward direction X.

As shown in FIGS. 4,5,6,9, 10 (particularly, see FIG. 9, 10) at the time of locking of the locking system 27, first, the operation knob 33 of the releasing unit 30 is grasped by the driver, and the ballast 25 is inserted together with the releasing unit 30 into the pocket 26 while locating the turn leg 32 in the arrangement space 56 of the female locking unit 50, and the ballast 25 is pushed into the pocket 26 until the turn leg 32 is brought in contact with the concave surface 57 of the female locking unit 50. Next, the hold portion 75*a* of the stationary member 72 of the male locking unit 70 is held by the driver, and against the urge of the movable member 73 of the male locking unit 70 in the forward direction X, the male locking unit 70 is pushed into the arrangement space 56 while the shoulder portions 83 are inserted into the guide grooves 58. At this time, the male locking unit 70 is moved in the forward direction X while the shoulder portions 83 are slid along the guide grooves 58 of the female locking unit 50 and the claws 76*a* of the hook arms 76 pass over the claws 59 of the female locking unit 50, so that the claws 76*a* of the hook arms 76 are hooked to the claws 59 of the female locking unit 50. Accordingly, the male locking unit 70 is restricted from moving in the backward direction Y, and the convex head edge 82 of the male locking unit 70 are brought in contact with the side edges 36 of the turn leg 32 of the releasing unit 30. As a result, the female locking unit 50 and the male locking unit 70 are coupled (locked) to each other.

In such a coupled state (locking state), the stabilizing protrusions 77 of the male locking unit 70 are fit in the receiving grooves 60, so that the male locking unit 70 is restricted from shifting in the width direction Z. Thus, the female locking unit 50 and the male locking unit 70 are more stably are coupled to each other, do not become loose even if receiving a relatively strong impact, and are not released from the coupled state.

As shown in FIGS. 4, 5, 9, 10 (particularly, see FIG. 9, 10), at the time of releasing of the locking system 27, which is operated by the diver as follows:

The operation knob 33 of the releasing unit 30 is grasped and forcedly turns it clockwise or the counterclockwise. By turning the operation knob 33 of the releasing unit 30, while the turn leg 32 of the releasing unit 30 is turned along the concave surface 59 that is brought in contact with the convex front surface 34 of the turn leg 32, and while the turn leg 32 that the convex front surface 34 is brought in contact with the shoulder portion 83 and/or the convex head edge 82 of the movable member 73 of the male locking unit 70 is turned along their convex shapes at a certain angle in the turning direction, so that the turn leg 32 pushes the movable member 73 in the backward direction Y, whereby the spring 86 is compressed in the backward direction Y. Successively, when the movable member 73 is slid in the backward direction Y, the shoulder portions 83 of the movable member 73 is brought in contact with the claws 76*a* of the hook arms 76 and the hook arms 76 is elastically deformed so as to shift toward the sides of the stationary member 72, so that the hooking of the claws 76*a* of the hook arms 76 to the claws 59 of the female locking unit 50 are released. At the same time, the male locking unit 70 is pulled out in the backward direction Y by expansion of the spring 86. With the spring force of the spring 86, the shoulder portions 83 and the hook arms 76 are pushed out in the backward direction Y from the guide grooves 58 of the female locking unit 50, and the male locking unit 70 is separated so as to jump out from the female locking unit 50 so that their engagement is released. As a result, the cover flap 28 is opened thoroughly, and then the opening 26*d* of the pocket 26 is exposed. Successively, when the operation knob 33 of the releasing unit 30 is drawn in the backward direction Y, the ballast 25 is completely pulled out from the pocket 26.

The diver's push portion 84 is provided for being held by the diver in case the male locking unit 70 is engaged with the female locking unit 50 without setting of the releasing unit 30 in the female locking unit 50 by the diver's carelessness. In case the male locking unit 70 is engaged with the female locking unit 50 as stated above, their engagement is difficult to be released so long as their engagement is not released by the diver's push in the backward direction Y with the push portion 84. The push portion 84 also serves to support to prevent the releasing unit 30 from too much inclining in the backward at the time of locking of the locking system 27.

It should be noted that, for example, in a case where a ballast is linked to a pocket by means of a push type locking system or a conventional buckle in which an operation knob is exposed in the outside, if the locking system or the buckle collides with rock or the like during diving, the locking is released unexpectedly, the ballast drops, and buoyancy compensation by the ballast cannot be performed. As a result, there is a risk that a diver may cause damage to the lung due to sudden surfacing. In the locking system 27 of the buoyancy compensator according to the embodiment of the present invention, due to a forceful turning operation for the releasing unit 30, the locking is released. Accordingly, even if the locking system 27 receives a relatively strong impact due to collision with rock, there is no concern that the locking is released carelessly. Further, in a case of coupling by means of a zip fastener, a string, or the like, a releasing operation with the diver's both hands is needed. Accordingly, when a diver wears gloves during diving, the releasing operation becomes difficult. In contrast, in the locking system 27 according to the embodiment of the present invention, a diver releases the locking by turning the releasing unit 30 while grasping the operation knob 33 of the releasing unit 30, and is allowed to remove the ballast 25 out of the pocket 26 of the vest 11 by pulling the releasing unit 30, as it is, in the backward direction Y. Accordingly, the driver can perform releasing of the locking of the locking system 27 and removing out of the ballast 25 relatively simply by the diver's one hand.

For each of the configuration portions of the buoyancy compensator, unless otherwise specified, in addition to the materials described in the specification of this application, various well-known materials generally used in this art may be used. In the range of the specification of this application and claims, the term "first" and "second" are used only to distinguish the same kind of elements, positions, and the like.

Some embodiments in accordance with the disclosure of the present invention may be arranged in at least one or more of the following features:

A buoyancy compensator having a locking system having a forward direction and a backward direction, includes:

a vest having a pocket in which a ballast is removably inserted;

a cover flap configured to openably close an opening of the pocket;

a locking system configured to openably close the cover flap;

the locking system includes a releasing unit attached to the ballast;

a female locking unit attached to the pocket; and a male locking unit attached to the cover flap and configured to be engageable with the female locking unit;

wherein:

the releasing unit includes a turn leg and an operation knob on the turn leg;

the female locking unit includes a frame including both side portions, a front end portion, an arrangement space defined by the both side portions and the front end portion, and a pair of first claws in the guide grooves;

the male locking unit includes a stationary potion, a movable member slidably inserted in the stationary member by a certain movement range in the forward and backward directions with being urged in the forward direction by a spring interposed between the stationary member and the movable member of the male locking unit;

in an engagement of the male locking unit to the female locking unit, the turn leg is arranged between the front end portion of the female locking unit and the movable member of the male locking unit, with the turn leg brought in contact with the front end portion and the movable member, the first claws of the female locking unit and the second claws of the hook arms of the male locking unit are releasably hooked to each other, when the turn leg is forcedly turned at a certain angle in a turn direction thereof by turn operation of the operation knob, the movable member of the male locking unit is pressurized by the turn leg of the releasing unit so as to slide in the backward direction against urge of the movable member by the spring in the forward direction, whereby the first claws of the hook arms of the stationary member that are hooked to the second claws of the female locking unit, is shifted to sides that hooking of the first and second claws are released, as a result, the engagement of the male locking unit to the female locking unit is released.

The present disclosure described above may include at least the following embodiments, which may be taken in isolation from or in combination with one another.

(1) The turn leg includes both side edges for bringing in contact with the movable member.

(2) The turn leg includes a foot turnably linked to the ballast by means of a strap piece in the turn direction, and the foot is interposed between the ballast and the front end portion of the female locking unit.

(3) The turn leg has a convex front surface.

(4) The female locking unit includes an arrangement space defined with an approximately U-shaped frame that is formed by the both side portions and the front end portion.

(5) The front end portion is provided on an inner surface thereof with a concave surface, with which the convex front surface of the turn leg is brought in contact.

(6) The female locking unit includes a pair of receiving grooves at opening ends of the guide grooves of the female locking unit.

(7) The movable member includes a convex head edge and a pair of shoulder portions, and at least one of the convex head edge and the shoulder portions are brought in contact with the side edges of the turn leg.

(8) The stationary member includes on both sides thereof with a pair of stabilizing protrusions to be inserted into the pair of receiving grooves of the female locking unit.

The invention claimed is:

1. A buoyancy compensator having a locking system having a forward direction and a backward direction includes:

a vest having a pocket in which a ballast is removably inserted;

a cover flap configured to openably close an opening of the pocket;

a locking system configured to openably close the cover flap;

the locking system includes a releasing unit attached to the ballast;

a female locking unit attached to the pocket; and a male locking unit attached to the cover flap and configured to be engageable with the female locking unit; wherein:

the releasing unit includes a turn leg and an operation knob on the turn leg;

the female locking unit includes a frame including both side portions, a front end portion, an arrangement space defined by the both side portions and the front end portion, and a pair of first claws in the guide grooves;

the male locking unit includes a stationary member and a movable member, the stationary member is provided with a pair of hook arms each having a second claw, the movable member is slidably inserted in the stationary member by a certain movement range in the forward and backward directions with being urged in the forward direction by a spring interposed between the stationary member and the movable member of the male locking unit;

in an engagement of the male locking unit to the female locking unit, the turn leg is arranged between the front end portion of the female locking unit and the movable member of the male locking unit, with the turn leg brought in contact with the front end portion and the movable member, the first claws of the female locking unit and the second claws of the hook arms of the male locking unit are releasably hooked to each other, when the turn leg is forcedly turned at a certain angle in a turn direction thereof by turn operation of the operation knob, the movable member of the male locking unit is pressurized by the turn leg of the releasing unit so as to slide in the backward direction against urge of the movable member by the spring in the forward direction, whereby the second claws of the hook arms of the male locking unit that are hooked to the first claws of the female locking unit, are shifted to sides that hooking of the first and second claws are released, as a result, the engagement of the male locking unit to the female locking unit is released.

2. The buoyancy compensator having the locking system according to claim 1, wherein the turn leg includes both side edges for bringing in contact with the movable member.

3. The buoyancy compensator having the locking system according to claim 1, wherein the turn leg includes a foot turnably linked to the ballast by means of a strap piece in the turn direction, and the foot is interposed between the ballast and the front end portion of the female locking unit.

4. The buoyancy compensator having the locking system, according to claim 1 wherein the turn leg has a convex front surface.

5. The buoyancy compensator having the locking system according to claim 1, wherein the female locking unit includes an arrangement space defined with an approximately U-shaped frame that is formed by the both side portions and the front end portion.

6. The buoyancy compensator having the locking system according to claim 5, wherein the front end portion is provided on an inner surface thereof with a concave surface, with which the convex front surface of the turn leg is brought in contact.

7. The buoyancy compensator having the locking system according to claim 1, wherein the female locking unit includes a pair of receiving grooves at opening ends of the guide grooves of the female locking unit.

8. The buoyancy compensator having the locking system according to claim 1, wherein the movable member includes a convex head edge and a pair of shoulder portions, and at least one of the convex head edge and the shoulder portions are brought in contact with the side edges of the turn leg.

9. The buoyancy compensator having the locking system according to claim 1, wherein the stationary member includes on both sides thereof a pair of stabilizing protrusions to be inserted into the pair of receiving grooves of the female locking unit.

* * * * *